US008864337B2

(12) United States Patent
Rains

(10) Patent No.: US 8,864,337 B2
(45) **Date of Patent: *Oct. 21, 2014**

(54) ROD LIGHT

(71) Applicant: Light Muse, LLC, Austin, TX (US)

(72) Inventor: Russell E. Rains, Austin, TX (US)

(73) Assignee: Light Muse, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/858,576

(22) Filed: Apr. 8, 2013

(65) Prior Publication Data

US 2013/0294055 A1 Nov. 7, 2013

Related U.S. Application Data

(63) Continuation of application No. 12/957,833, filed on Dec. 1, 2010, now Pat. No. 8,414,157.

(51) Int. Cl.

| | |
|---|---|
| ***F21V 23/04*** | (2006.01) |
| ***F21V 23/00*** | (2006.01) |
| ***F21L 13/00*** | (2006.01) |
| ***A47K 3/28*** | (2006.01) |
| ***H05B 37/02*** | (2006.01) |
| ***F21V 33/00*** | (2006.01) |
| ***F21L 4/02*** | (2006.01) |
| ***F21V 21/08*** | (2006.01) |
| ***F21L 4/00*** | (2006.01) |
| ***F21V 21/088*** | (2006.01) |
| *F21Y 101/02* | (2006.01) |

(52) U.S. Cl.

CPC ..... *F21L 15/14* (2013.01); *F21Y 2101/02* (2013.01); *A47K 3/281* (2013.01); *H05B 37/0263* (2013.01); *F21V 33/0012* (2013.01); *F21L 4/02* (2013.01); *F21L 4/00* (2013.01); *F21V 21/0885* (2013.01)

USPC ..... 362/276; 362/183; 362/234; 362/253; 362/295; 362/394

(58) Field of Classification Search

CPC ..... A47K 3/281; F21L 4/00; F21L 4/02; F21V 21/0885; F21V 33/0012; H05B 37/0263

USPC ..... 362/183, 234, 253, 295, 276, 394

See application file for complete search history.

(56) References Cited

U.S. PATENT DOCUMENTS

| | | | |
|---|---|---|---|
| 3,088,024 | A | 4/1963 | Lowell |
| D234,968 | S | 4/1975 | Ervin |

(Continued)

FOREIGN PATENT DOCUMENTS

| | | |
|---|---|---|
| EP | 0502435 | 9/1992 |

OTHER PUBLICATIONS

"Clip-On LED Mirror Light MyLight" accessed at <http://www.showertek.com/clip-on-led-mirror-light-p-203.html>, Aug. 12, 2010. (pp. 1-2).

*Primary Examiner* — Stephen F Husar
*Assistant Examiner* — James Cranson, Jr.
(74) *Attorney, Agent, or Firm* — Meyertons, Hood, Kivlin, Kowert & Goetzel, P.C.; Eric B. Meyertons

(57) ABSTRACT

A portable lighting system including a housing having an elongated slot formed in a surface of the housing. The slot being sized to receive a rod therein via an opening in the slot. The system further including a retention member movable between a closed position and an opened position, wherein the closed position provides at least a portion of the retention member blocking at least a portion of the upper opening of the slot and the opened position includes the retention member not blocking the upper opening of the slot. The system also having a light source including a plurality of lights oriented in different directions.

20 Claims, 5 Drawing Sheets

(56) References Cited

U.S. PATENT DOCUMENTS

| | | | | |
|---|---|---|---|---|
| D411,322 | S | 6/1999 | Suzuki | |
| 6,637,676 | B2 | 10/2003 | Zieger et al. | |
| 7,178,746 | B2 | 2/2007 | Gross | |
| 7,188,978 | B2 | 3/2007 | Sharrah et al. | |
| D567,994 | S | 4/2008 | Chan et al. | |
| D577,458 | S | 9/2008 | Chan et al. | |
| D577,846 | S | 9/2008 | LaBuzetta | |
| D586,935 | S | 2/2009 | Lassen | |
| D625,879 | S | 10/2010 | Sabernig | |
| 7,841,732 | B2 | 11/2010 | Coushaine et al. | |
| D648,470 | S | 11/2011 | Rains | |
| 8,151,385 | B2 | 4/2012 | Goskowski et al. | |
| 8,167,450 | B2 | 5/2012 | Hudson | |
| 8,388,169 | B2 * | 3/2013 | Crawford et al. | 362/202 |
| 8,414,157 | B2 * | 4/2013 | Rains | 362/276 |
| 2004/0228143 | A1 | 11/2004 | Squicciarini | |
| 2008/0016613 | A1 | 1/2008 | Chien | |

* cited by examiner

ROD LIGHT

PRIORITY CLAIM

This application is a continuation of U.S. Provisional application Ser. No. 12/957,833 entitled "ROD LIGHT" filed Dec. 1, 2010, which is incorporated herein by reference in its entirety.

BACKGROUND

1. Field of the Invention

The present invention relates to lighting systems, and more particularly to a lighting system for use in a bathing environment.

2. Description of Related Art

Bathing facilities, such as residential bathrooms, are often lighted via an overhead light or other lighting device. For example, lighting for a home bath or shower is typically provided from a light fixture in the room's ceiling. Unfortunately, the resulting illumination may not be sufficient or at least optimal for bathing. For example, the light fixture itself may be located some distance away from the bath or shower or a portion of the bath or shower, such as a shower curtain, may block the light from illuminating the bathing and showering areas. As a result, a person using the bath or shower may not be able to see items located within the bath or shower, or may have difficulty maneuvering within the bath or shower. For example, persons showering may not be able to locate bathing products, such as soap and shampoo, or may have difficulty seeing where it is safe to step. Although these conditions may not be particularly limiting for some persons, they can be increasingly limiting for others. For example, the elderly or disabled may not be able to safely maneuver within the bath or shower as a result of the low lighting conditions. Even where additional lighting is not a necessity, persons may desire to have adequate lighting for shaving, reading labels on soap/shampoo containers, cleaning the bathing environment, or the like.

Traditional solutions to the shortcomings of traditional lighting may include, for example, installing additional lighting fixtures within the room. Unfortunately, such a solution may be permanent and costly and, thus, may not be well adapted for use in temporary applications. For example, it may not be possible or practical to install a fixture within a hotel bathroom, an apartment, or other location where installation of a permanent and/or costly lighting fixture is not desirable or even possible.

Accordingly, it is desirable to provide a technique for illuminating a bath or shower. Moreover, it is desirable to provide a technique for lighting that is portable and cost efficient.

SUMMARY

Various embodiments of lighting systems and related apparatus, and methods of operating the same are described. In some embodiments, provided is a portable bathing lighting system that includes an elongated housing having an elongated slot formed in an upper surface of the housing. The slot is substantially parallel to a longitudinal axis of the elongated housing and is sized to receive a shower curtain rod therein via an upper opening in the slot. The housing also includes a retention member movable between a closed position and an opened position. The closed position provides at least a portion of the retention member blocking at least a portion of the upper opening of the slot such that when the rod is disposed within the slot, the portion of the retention member inhibits removal of the rod from the slot, and the opened position provides for the retention member not blocking the upper opening of the slot to facilitate insertion or removal of the rod into or out of the slot. The system also having a light source that includes a first light oriented to provide illumination in a first direction of a first light axis and a second light oriented to provide illumination in a second direction of a second light axis, wherein the first and a second light axes are oriented oblique to one another.

In some embodiments, provided is a portable lighting system including a housing having an elongated slot formed in a surface of the housing. The slot being sized to receive a rod therein via an opening in the slot. The system further including a retention member movable between a closed position and an opened position, wherein the closed position provides at least a portion of the retention member blocking at least a portion of the upper opening of the slot and the opened position provides for the retention member not blocking the upper opening of the slot. The system also having a light source including a plurality of lights oriented in different directions.

In some embodiments, provided is a portable bathing lighting system that includes a housing configured to be secured to a shower curtain rod. The housing including an elongated slot sized to receive a shower curtain rod therein and a retention member movable between a closed position to inhibit removal of the shower curtain rod from the slot and an opened position to facilitate insertion or removal of the shower curtain rod into or out of the slot. The system also including a light source selectively activateable by a user, wherein the light source is configured to illuminate a bath/shower during use.

In some embodiment, provided is a portable bathing lighting system including a housing to be secured to a shower curtain rod, a light source selectively activateable by a user, wherein the light source is configured to illuminate a bath/shower during use. The light source including a power source, one or more lights, a pulse width modulator configured to generate a pulse train signal, and a controller configured to regulate the power provided to the lights such that the lights are pulsed at a rate corresponding to a pulse train generated by the pulse width modulator.

In some embodiment, provided is a method that includes receiving a pulse train signal and regulating the power provided to one or more lights from a portable power source such that the one or more lights are pulsed at a rate corresponding to the pulse train. The one or more lights are provided in a bathing lighting system housing configured to be coupled to a shower curtain rod.

In some embodiments, provided is a portable lighting system that includes a housing to couple to a rod in a bathing environment and a light source to broadcast light to multiple portions of the bathing environment during use

BRIEF DESCRIPTION OF THE DRAWINGS

Advantages of the present invention will become apparent to those skilled in the art with the benefit of the following detailed description and upon reference to the accompanying drawings in which.

Figure 1:
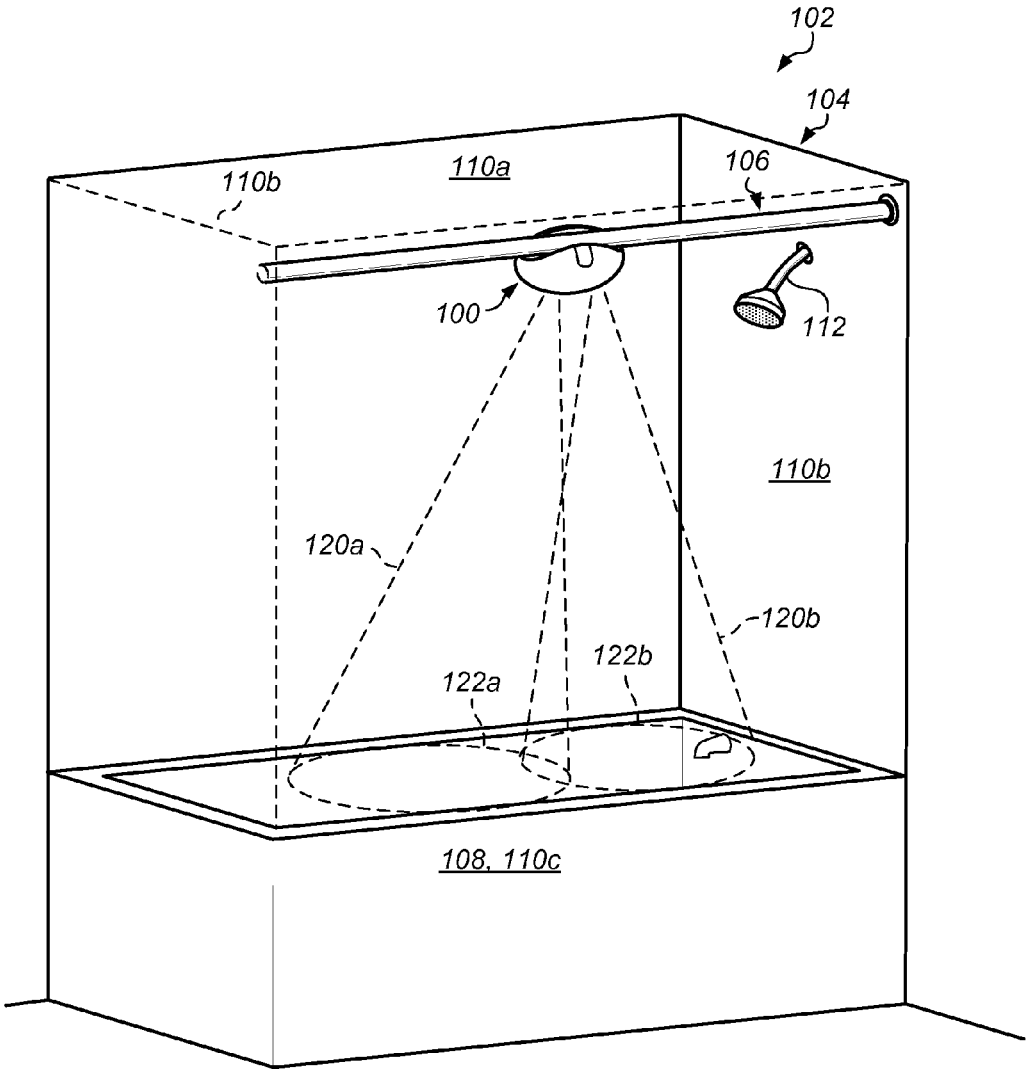
FIG. 1 is a diagram that illustrates a perspective view of a lighting system coupled to a shower curtain rod in accordance with one or more embodiments of the present technique.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF ILLUSTRATIVE EMBODIMENTS

As discussed in more detail below, certain embodiments of the present technique include a lighting system for use in a bathing environment, such as a shower or a bathtub. Although certain embodiments refer to a bath or showering environment, the embodiments described herein may be applicable to all bathing environments, including both baths and showers. In some embodiments, provided is a lighting system that can be coupled to a shower rod or similar member. In certain embodiments, the lighting system includes a body having a recess, such as a slot or channel that can be fit over and coupled to a shower rod to affix the lighting system thereto. In certain embodiments, the lighting system includes a retention device, such as a clip, for securing the lighting system to the shower rod. In some embodiments, the retention device includes a spring biased clip for coupling the lighting system to the shower rod. In certain embodiments, a gripping member (e.g., traction pad) is provided within the slot to inhibit the lighting system from rotating about the shower rod.

In some embodiments, the lighting system includes one or more lights for illuminating the bathing environment. In certain embodiments, the lighting system includes two or more lights focused or otherwise directed in different directions to illuminate respective areas of the bathing environment. In some embodiments, the lights are directed oblique to one another (e.g., at a diverging angle relative to one another) to illuminate adjacent areas of the bathing environment. In certain embodiments, each of the lights is selectively operable such that none, some or all of the lights may be illuminated at a given time. In some embodiments, the lights provide area lighting (e.g., flood lighting) and/or a narrow beam of light (e.g., focused lighting). In certain embodiments, the lights include light emitting diodes (LEDs). In certain embodiments, the lights operate on a timer such that they are activated for a given period of time, automatically turning off after the period of time has expired. In some embodiment, the lighting system includes a sealed water-resistant/proof housing. In certain embodiments, the lighting system is battery operated. In some embodiments, the battery is rechargeable via a port located at an exterior of the housing.

Turning now to the figures, FIG. 1 is a diagram that illustrates a lighting system 100 disposed in a bathing environment 102 in accordance with one or more embodiments of the present technique. In the illustrated embodiment, bathing environment 102 includes a bathtub/shower 104 and a shower curtain rod 106. Bathtub/shower 104 may include a bathtub 108 and/or sidewalls 110*a* and 110*b*. Bathing environment 102 may include a water source 112, such as a shower head or faucet. Generally, water source 112 may be located on a side wall 110*b* of shower/bathtub 102, but other arrangements are envisioned. For instance, water source 112 may be located overhead. In the case of a shower or a shower/bathtub combination, bathtub/shower 104 may include at least one low height wall or wall portion 110*c*. Typically a person using such a shower/bathtub may have to step over the low height wall 110*c* to enter the shower/bathtub.

Shower curtain rod ("rod") 106 may include a rigid elongated rod member that is secured within bathing environment 102 for supporting a shower curtain or similar water barrier. For example, rod 106 may includes a rigid rod extending across an opening of bathtub/shower 104 to support a shower curtain that blocks water from splashing out of bathtub/shower 104. In some embodiments, rod 106 may extend between sidewalls 110*b* of bathtub/shower 104. For example, in the illustrated embodiment, rod 106 extends between sidewalls 110*b* located at opposite ends of bathtub/shower 104. In some embodiments, rod 106 may have a deployed length that is about the same as a length of a bathtub or similar opening spanned by rod 106. Rod 106 may have a length of about four feet to about six feet when used to span end-walls of a bathtub, for example. Rod 106 may have a length of about three feet to about four feet when used to span a doorway of shower stall, for instance. In some embodiments, rod 106 may be removably secured or fixed to end walls 110*b*. In some embodiments, rod 106 may include a cross-section of various shapes. For example, in the illustrated embodiment, rod 106 includes a generally circular cross-section such that rod 106 includes an elongated cylindrical tube extending between end-walls 110*b*. Other embodiments may include various cross-sectional shapes, such as oblong, triangular, square, rectangular, or other polygonal shapes. Rod 106 may be substantially straight, or may include a bow/curvature along its length. In some embodiments, rod 106 includes a rigid member formed of a plastic, metal, a composite material or the like.

During use, lighting system 100 may be coupled to rod 106, or a similar supporting member within a bathing environment. For example, in the illustrated embodiment, lighting system 100 is coupled to rod 106 located above bathtub/shower 104 and secured between end walls 110*b*. Lighting system 100 may broadcast lighting to one or more portions of the bathing environment. For example, in the illustrated embodiment, lighting system 100 includes two lights directed downward and at an angle relative to one another to provide beams of light 120*a*/120*b* that, during use, illuminate of areas 122*a*/122*b* proximate opposite ends of bathtub 108. In some embodiments, lighting system 100 may provide a relatively wide beam(s) of light (e.g., area lighting) that illuminate a relatively large area/portion of the bathing environment. Such an embodiment may include flood type lighting that provides for general area lighting/illumination that improves a person's ability see an increased amount, a majority or even substantially all of the bathing environment 102. In some embodiments, lighting system 100 may provide a relatively narrow beam of light (e.g., focused lighting) to illuminate a particular or relatively small portion of the bathing environment. Such an embodiment may provide for focused lighting that may improve a person's ability see a particular portion of the bathing environment 102. For example, beams 120*a* and 120*b* may be focused on the base of bathtub 108 and a faucet of bathtub 108, respectively, to provide focused lighting at these locations. In some embodiments, lighting system may provide lighting of various intensities. For example, a user may select between a bright (e.g., high intensity light) setting or a dim (e.g., low intensity) setting. Lighting system 100 may include more than two levels of lighting intensities for a user to select from. In some embodiments, the intensity may be variable such that a user has an almost infinite number of settings to choose from. In some embodiments, each of the lights may be provided at different intensities. For example, one light may be bright while the other light is dim. Although the illustrated embodiment includes two beams of light 120*a* and 120*b* provided by two lights, other embodiments may include any number of lights and respective beams of light, as discussed in more detail below. Further, although the illustrated embodiment includes lighting system 100 coupled to rod 106 located above and to the side of a bathtub/shower 104, other embodiments may include lighting system 100 coupled to other location within bathing environment 102. For example, lighting system 100 may be coupled to a grab-bar located within bathtub/shower 104, to a faucet, a pipe extending to shower head 112, or even a rack located inside of or proximate shower 104.

In some embodiments, lighting system 100 may be removably coupleable to a rod, or a similar supporting member within a bathing environment. For example, lighting system 100 may simply clip onto rod 106 such that a user can install and uninstall lighting system 100 within bathing environment 102 without substantial assembly. Lighting system 100 may simply clip onto rod 106 without the use of tools (e.g., a screwdriver), mechanical fasteners (e.g., screws), adhesives or the like. Such an embodiment may enable lighting system 100 to be portable such that a user can easily move lighting system 100 from one bathing environment to another. For example, a person may move lighting system 100 between different bathrooms of their home. While traveling, a person may move lighting system 100 between various shower rods of different hotel room bathrooms.

Figure 2A:
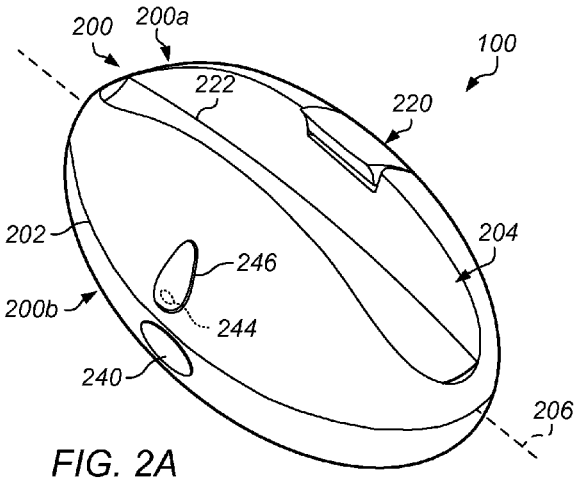
FIG. 2A is a diagram that illustrates a top/front-perspective view of a lighting system in accordance with one or more embodiments of the present technique.
Figure 2B:
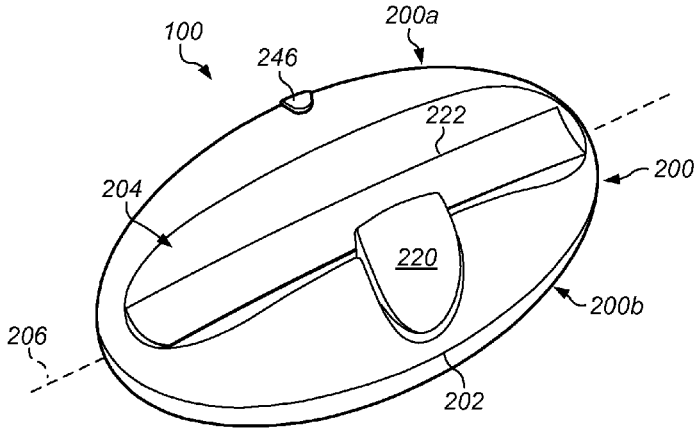
FIG. 2B is a diagram that illustrates a top/rear-perspective view of the lighting system in accordance with one or more embodiments of the present technique.
Figure 2C:
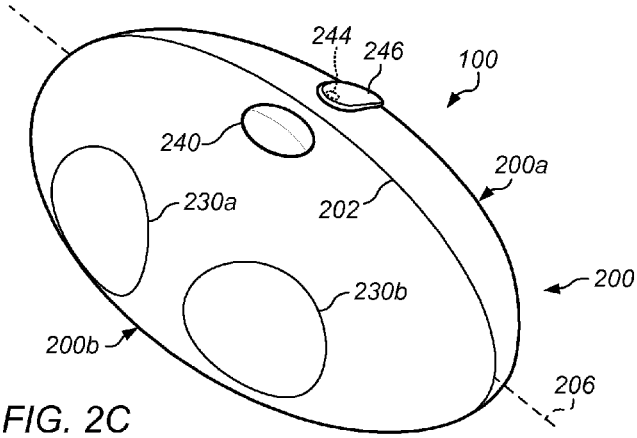
FIG. 2C is a diagram that illustrates a bottom/front perspective view of the lighting system in accordance with one or more embodiments of the present technique.
Figure 2E:
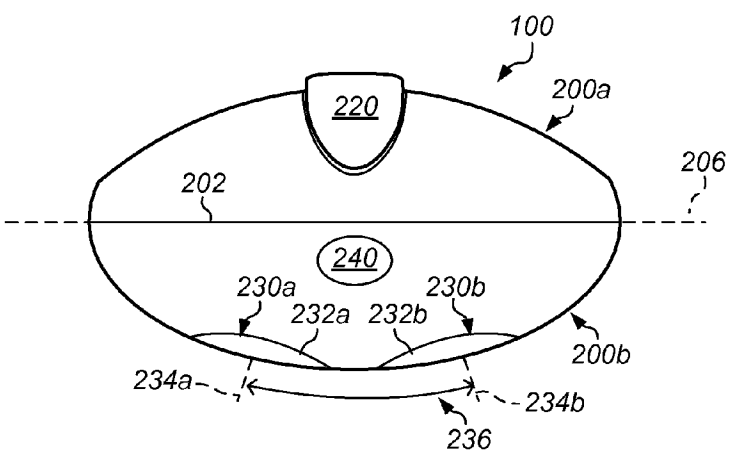
FIG. 2E is a diagram that illustrates a rear view of the lighting system in accordance with one or more embodiments of the present technique.
Figure 2D:
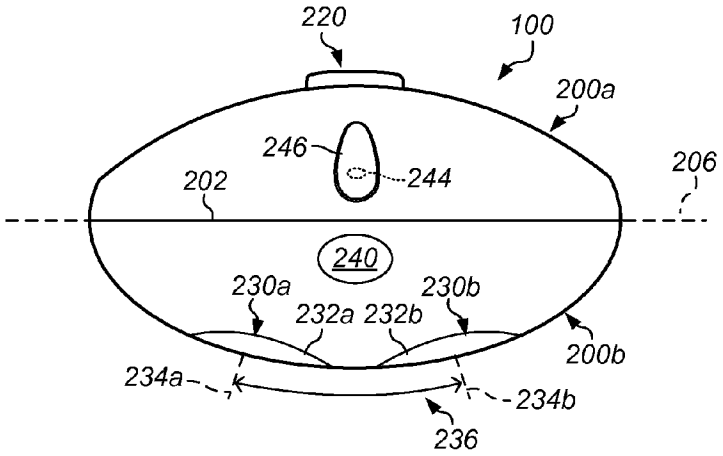
FIG. 2D is a diagram that illustrates a front view of the lighting system in accordance with one or more embodiments of the present technique.
Figure 2G:
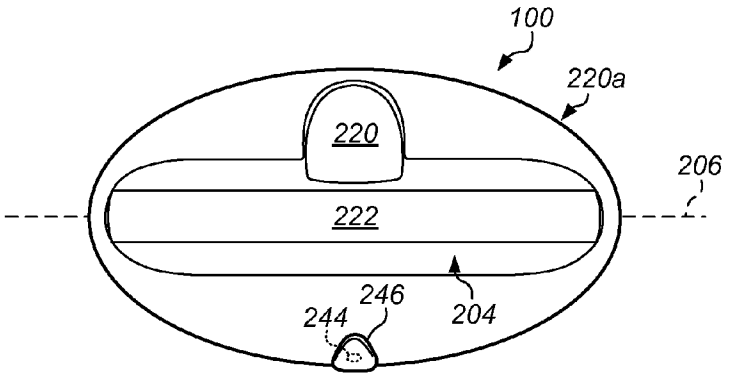
FIG. 2G is a diagram that illustrates a top view of the lighting system in accordance with one or more embodiments of the present technique.
Figure 2F:
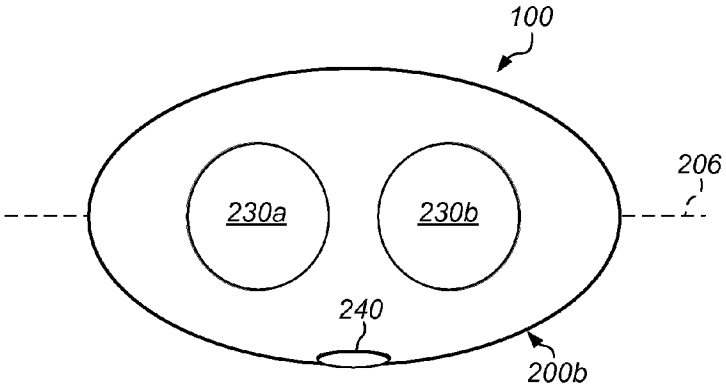
FIG. 2F is a diagram that illustrates a bottom view of the lighting system in accordance with one or more embodiments of the present technique.
Figure 2H:
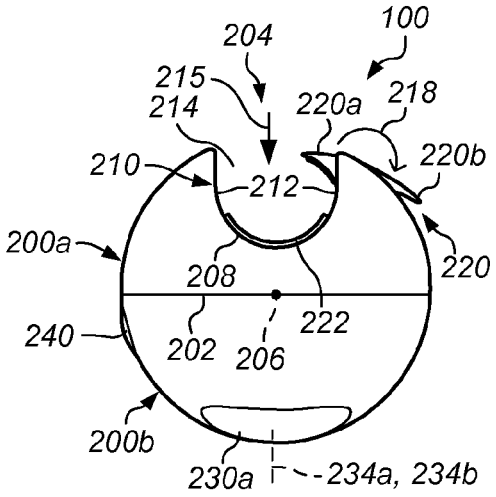
FIG. 2H is a diagram that illustrates a right-side view of the lighting system in accordance with one or more embodiments of the present technique.
Figure 2I:
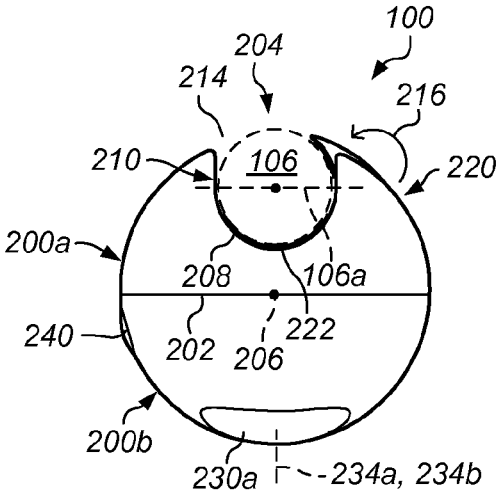
FIG. 2I is a diagram that illustrates a right-side view of the lighting system including a rod disposed therein in accordance with one or more embodiments of the present technique.
Figure 3A:
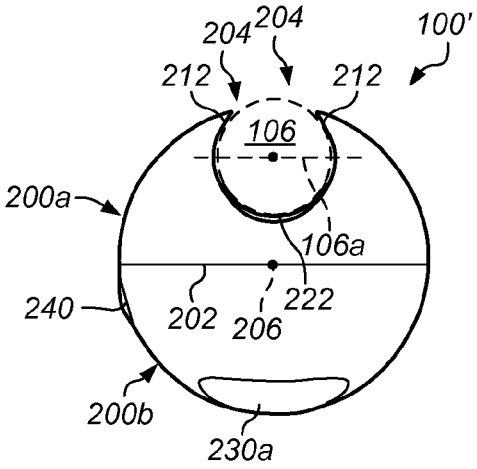
FIGS. 3A and 3B are diagrams that illustrate right-side views of lighting systems coupled to a rod in accordance with one or more embodiments of the present technique.
Figure 3B:
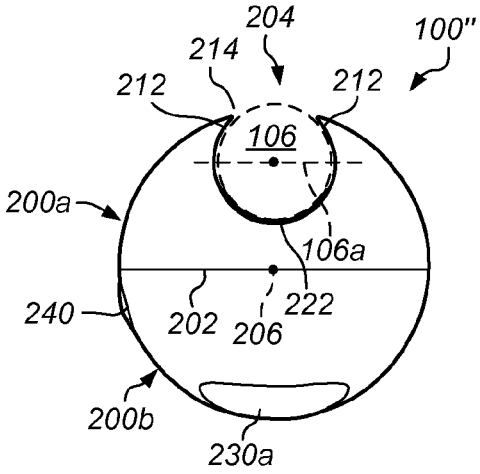

FIGS. 2A-2I include various diagrams illustrating lighting system 100 in accordance with one or more embodiments of the present technique. More specifically, FIGS. 2A-2I illustrate a top/front-perspective view, a top/rear-perspective view, a bottom/front perspective view, a front view, a rear view, a bottom, a top view, a first right-side view and a second right side view including a rod, respectively, of lighting system 100 in accordance with one or more embodiments of the present technique. FIGS. 3A and 3B are diagrams that illustrate right-side views of alternate embodiments of lighting systems 100' and 100" coupled to a rod 106 in accordance with one or more embodiments of the present technique. System 100' and 100" may include the same or similar features as those described with respect to system 100. Systems 100' and 100" may include alternate embodiments of a slot/channel of housing 200 as described in more detail below.

In some embodiments, lighting system 100 includes a housing or similar enclosure. In the illustrated embodiments, lighting system 100 includes housing 200. Housing 200 may include a water tight (e.g., water resistant or waterproof) enclosure for housing components of lighting system 100. In some embodiment, housing 200 may include two or more shells coupled to one another to form a single enclosure. For example, in the illustrated embodiment, housing 200 includes an upper housing portion 200*a* and a lower housing portion 200*b* coupled to one another via a seam 202 (See at least FIGS. 2A and 2B). Seam 202 may be formed via a mechanical coupling (e.g., a protrusion clipped into a complementary recess), an adhesive, and/or other forms of coupling (e.g., ultrasonic welding). In the illustrated embodiment, seam 202 runs longitudinally along a length of housing 200. In some embodiments, housing may include two right and left portions coupled to one anther via a lateral seam. Other embodiments housing 200 may include any number of shells and seams provided in various orientations and shapes. In some embodiments, upper and lower housing portions 200*a* and 200*b* may be coupled to one another via mechanical fasteners, such as screws.

Housing 200 and lighting system 100 may have any desirable shape. For example, housing 200 and lighting system 100 may include a spherical shape, cubic shape, rectangular shape, or the like. In the illustrated embodiment, housing 200 and lighting system 100 includes a generally substantially regular ellipsoid shape, similar to that of a football. Such a shape may be conducive to handling by a person. For example, a user may be able to comfortably grasp lighting system 100 via housing 200 during installation, removal and transport. In some embodiments, an exterior of housing 200 may have a textured surface to facilitate handing. For example, a portion or substantially all of an exterior surface of housing 200 may have a texture formed integrally (e.g., formed with a rough finish) and/or coated thereon (e.g., a rubberized coating applied to the exterior surface).

In some embodiments, housing 200 may have a length of about three inches, four inches, five inches, six inches, seven inches, eights inches or more. In some embodiments, lighting system 200 may have an overall length/width that enables placement of lighting system 100 between shower curtain rings. For example, to accommodate a shower curtain having holes for rings spaced about six inches apart, housing 200 may have length of less than about six inches such that it may be secured to a shower curtain rod (e.g., rod 106) between adjacent shower curtain hooks/rings installed in the holes and used to couple the shower curtain to the shower rod.

In some embodiments, lighting system 100 includes a recess configured to capture at least a portion of a supporting member during use. For example, in the illustrated embodiment, housing 200 includes an elongated slot/channel 204 located at the uppermost portion of upper housing portion 200*a* and extending substantially parallel to a longitudinal axis 206 extending along a length of housing 200 (See at least FIGS. 2A, 2B and 2F). In some embodiments, a slot/channel 204 may not be substantially parallel to longitudinal axis 206. For example, a slot/channel may be substantially parallel to a lateral axis of housing 200 such that it is substantially perpendicular to slot/channel 204 depicted. In some embodiments, multiple slots/channels may be provided in various orientations to enable the user to mount system 100 in a variety of orientations relative to a complementary rod. Slot/channel 204 may be shaped to fit around and/or couple to a rod. For example, in the illustrated embodiment, slot/channel 204 includes a C-shaped recess that is complementary to the shape and/or size of rod 106 (See at least FIGS. 2H and 2I). In the illustrated embodiment, slot/channel 204 includes a curved/semi-circular lower portion 208. Slot/channel 204 also includes generally straight upper portion 210 including substantially straight/flat sidewalls 212 extending from lower portion 208 to an upper surface of housing 200. Sidewalls 212 extend substantially tangential from the ends of the semi-circular lower portion 208. During use, rod 106 may be disposed into slot/channel 204 via an opening 214 such that lower surface of rod 106 is proximate to lower portion 208 of slot/channel 204, and side and/or surfaces of rod 106 are contained between side-walls 212 of upper portion 210. For example, as depicted in FIG. 2I, a lower surface of rod 106 may abut the surface of lower portion 210 of slot/channel 204 with an upper portion of rod 106 (e.g., a portion of rod 106 above a centerline 106*a* of rod 106) disposed between side-walls 212 of upper portion 210. During use, slot/channel 204 may be advanced laterally over rod 106, such that rod 106 is advanced into slot/channel 204 in the direction of arrow 215.

Slot/channel 204 may be sized conducive to capture and retention of rod 106. In some embodiments, lower portion 208 may have a radius having a radius that is slightly larger than, slightly less than, or substantially the same as that of the radius of rod 106 and/or upper portion 210 may have a width that is slightly larger than, slightly less than, or substantially the same as that of the diameter of rod 106. For example upper walls 212 may be separated by a distance that is substantially the same as the diameter of rod 106 such that opening 214 has a width that is substantially the same as the diameter of rod 106. In some embodiments, lower portion 208 and/or upper portion 210 may have a radius and/or a width, respectively, that is slightly less than the radius/diameter of rod 106. Such sizing may facilitate an interference fit between walls of slot/channel 204 and an exterior surface of rod 106, thereby facilitating the retention of rod 106 within slot/channel 204. Thus, a user may mount system 100 to rod 106 via simply pushing rod 106 into slot/channel 204 such that slot/channel 204 squeezes about rod 106 to couple system 100 to rod 106 via the resulting interference fit between surfaces of rod 106 and surfaces of slot/channel 204.

In some embodiments, lower portion 208 and/or upper portion 210 may have a radius and/or a width, respectively, that is slightly greater than the radius/diameter of rod 106 such that opening 214 has a width that is slightly larger than the diameter of rod 106. Such sizing may reduce interference between rod 106 and housing 102, thereby enabling a user to mount system 100 to rod 106 via simply sliding slot/channel 204 onto rod 106 with little to no resistance. In some embodiments, lower portion 208 may be sized substantially the same or slightly greater than a size (e.g., radius) of rod 106 and at least a portion of upper portion 210 to be disposed above centerline 106*a* of rod 106 during use may be sized substantially the same or slightly smaller (e.g., narrower) than a size (e.g., diameter) of rod 106 such that opening 214 has a width that is substantially the same or slightly smaller than the diameter of rod 106. Such sizing may enable rod 106 to be secured within lower portion 208 of slot/channel 204 and be retained within slot/channel 204 via the narrower/necked portion of upper portion 210 that blocks/inhibits removal of rod 106 from slot/channel 204. In some embodiments, upper portion 210 may include a taper that reduces in width from lower portion 208 to the top of slot/channel 204 at or near the upper surface of housing 200. For example, upper portion 210 may include side walls 212 (e.g., substantially straight side walls 212) that are tapered inward as depicted in FIG. 3A and/or a curved sidewalls 212 (e.g., of slot/channel 204 having a substantially circular cross-section) that taper inward as depicted in FIG. 3B. In such embodiments, rod 106 may be retained within slot/channel 204 with or without the aid of a clip or similar retention device. For example, a user may simply snap system 100 onto rod 106 by pushing rod 106 into slot/channel 204. As rod 106 is advanced into slot/channel 204, upper walls 212 may expand outward to accommodate the width of rod 106 and may contract about upper portions of rod 106 as rod 106 is advanced into lower portion 208 of slot/channel 204. Thus, upper walls 212 of slot/channel 204 may snap around, grip or otherwise retain rod 106 within slot/channel 204.

In some embodiments, a retention member may be employed to provide for or otherwise aid in retention of rod 106 within slot/channel 204 during use. A retention member may be used with any sizing or shape of slot/channel 204. For example, in the illustrated embodiment, lighting system 100 includes a clip 220 (See at least FIGS. 2A, 2B, 2D, 2F, 2G and 2H). During use, clip 220 may be employed to secure rod 106 within slot/channel 204 or otherwise inhibit/block removal of rod 106 from slot/channel 204. Clip 220 may be spring biased toward a closed position that retains rod 106 within slot/channel 204. For example, as depicted in FIGS. 2H and 3I clip 220 may include a member that is biased to rotate counter-clockwise in the direction of arrow 216 such that a retention portion (e.g., tip) 220*a* of clip 220 extends into slot/channel 204. During use, a user may simply depress a tail end 220*b* of clip 220 to provide an opening force in the direction of arrow 218 to overcome the spring bias, to thereby rotate clip 220 clockwise into an opened position. In the opened position, tip 220*a* may be moved away from slot 204 such that rod 106 can be slid into and out of slot 204. For example, when clip 220 is rotated clockwise, tip 220*a* may not block slot/channel 204 such that rod 106 may be moved vertically in the direction of arrow 215 through opening 214 into slot/channel 204. With rod 106 disposed in slot/channel 204, the user may remove the opening force, thereby enabling the biasing force to rotate clip 220 counter-clockwise toward the closed position, as indicated by arrow 216 of FIG. 2I. As depicted in FIG. 2I, with rod 106 disposed in slot/channel 204, tip 220*a* of clip 220 may rotate into contact with an upper surface of rod 106. Thus, the biasing force of clip 220 may act against rod 106 via tip 220*a* which extends over opening 214 of slot/channel 204 in the closed position, thereby securing/capturing rod 106 within slot/channel 204. In the illustrated embodiment, a single clip 220 is provided on a rear side of slot/channel 204 and is substantially centered along a length of slot/channel 204. In other embodiments, multiple clips may be employed. For example, clips may be provided on both sides of slot/channel 204 and/or multiple clips may be provided along a length of slot/channel 204 on one or both sides of channel 104.

Slot/channel 204 may include additional features for facilitating the coupling of system 100 to rod 106. In some embodiments, slot/channel 204 may include surface features that provide a friction that acts upon a surface of rod 106 to inhibit system 100 from moving relative to rod 106. For example, in the illustrated embodiment, a surface of lower portion 208 of slot/channel 204 includes a grip member 222 disposed thereon that is configured to inhibit movement of system 100 relative to rod 106. In some embodiments, grip member 222 includes a piece of tape having a sticky/tacky surface. Grip member 222 may be adhered to a surface of slot/channel 24 via an adhesive. In some embodiments, grip member 222 is provided on a portion, a majority, of substantially all of an interior surface of slot/channel 204. For example, in the illustrated embodiment, grip member 222 includes a strip that spans substantially an entirety of the length of slot/channel 204. In some embodiments, grip member 222 may be resilient such that it facilitates maintaining a securing force against a surface of rod 106. For example, as depicted in FIGS. 2H and 2I, grip member 222 may have sufficient thickness to extend from a surface of slot 204 such that it is compressed when rod 106 is disposed in slot 204. The resulting compression may provide a resilient force acting to press rod 106 upward against tip 210*a* of clip 210 or tapered portions of upper portion 210 described above. In some embodiments, a similar grip member may be provided on an interior surface of tip 210*a* of clip 210 to promote retention of rod 106. The resilient nature of grip member 222 and its ability to be compressed may also enable slot 204 to accommodate various sizes and shapes of rods. For example, where rod is smaller than the size of slot 204, grip member may help to fill-in the difference in size by bridging the gap between the surface of slot 204 and a surface of rod 106, thereby effectively reducing the diameter of slot//channel 204. In some embodiments, grip member 222 may be provided along some, a majority, or substantially all of the interior surface of slot/channel 204. In some embodiments, grip member 222 may be formed of rubber, foam, or the like. In some embodiments, grip member 22 may be formed as an integral surface of slot 204.

System 100 may include any number and type of lights for providing a desired amount and pattern of illumination. In the illustrated embodiment, system 100 includes a light source that includes two lights 230*a*/230*b*. In some embodiments, lights 230*a*/230*b* may include light emitting diodes (LEDs) or other types of lights, such as incandescent light bulbs, halogen light bulbs, fluorescent light bulbs, high-intensity discharge lamps, sodium lamps, or the like. In some embodiments, lights 230*a*/230*b* include a light source disposed within housing 200 that emits light via a lens or similar transparent opening provided in housing 200. For example, in the illustrated embodiment, lenses 232*a*/232*b* are provided within substantially round openings in a lower surface of lower housing portion 200*b*. In some embodiments, lenses 232*a*/232*b* may have an external contour substantially the same as the contour of the surface of housing 200. For example, lenses 232*a*/232*b* may have a generally convex external contour. Such a convex lens shape may also help to disburse light beams (e.g., light beams 120*a* and 120*b*) passing there through to promote the broadcast of light across a wider area. In some embodiments, the internal contour of lenses 323*a*/323*b* may be concave. In some embodiments, lenses 232*a*/232*b* may aid in magnifying the intensity of the light via a light tunneling effect. In some embodiments, lenses may include surface features that provide for a directing light in a specific manner. For example, an interior surface of lenses 232*a*/232*b* may be smooth to promote the direct passage of light there through. In some embodiments, the interior surface of lenses 232*a*/232*b* may include a substantially non-smooth surface having indentations/protrusions that facilitate the diffusion of light as it passes through lenses 232*a*/232*b*. In some embodiments, lenses may be formed as an integral portion of housing 200. For example, lower housing portion 200*b* may be molded to include lenses 232*a*/232*b* or lenses 232*a*/232*b* may be fastened thereto via a mechanical fastener, an adhesive, ultrasonic welding or the like. In some embodiments, lenses 230*a*/230*b* may be provided as a component of a lighting assembly disposed within housing 200.

In some embodiments, lights may be position such that their respective beams of light are provided at a given angle relative to one another. For example, lights may be positioned such that the resulting beams of light are substantially parallel to one another, or oblique to one another (e.g., diverging or converging with respect to one another). In the illustrated embodiment, lights 230*a* and 230*b* are positioned such that the resulting beams of lights 120*a* and 120*b* diverge from one another. For example, lights 230*a* and 230*b* are positioned such that their beams of light 120*a* and 120*b* are directed along light axes 234*a* and 234*b*, respectively. In some embodiments, light axes 234*a* and 234*b* may have an angle 236 between them that ranges anywhere from about zero degrees to about one-hundred eighty degrees. For example, light axes 234*a* and 234*b* may be oriented oblique to one another, having an angle 236 there between of about fifteen degrees to about ninety degrees. In the illustrated embodiment, light axes 234*a* and 234*b* have an angle 236 of about thirty degrees there between. In some embodiments, light axes are oriented along a single plane. For example, in the illustrated embodiment, light axes 234*a* and 234*b* are both parallel to a vertical plane passing through axis 206, as can be seen in FIGS. 2H and 2I. Other embodiments, may include any number of lights having varying orientations. For example, a third light may be provided between lights 230*a* and 230*b* that is directed directly downward between lights 230*a* and 230*b*.

In some embodiments, operation of lights or other functions of system 100 may be provided via a user input. For example, a user may simply depress a button to activate some or all of the lights of system 100. In the illustrated embodiment, system 100 includes a button 240 that may be depressed by a user to provide a user input. Depressing button 240 may generate a signal that is received at a controlling device (e.g., controller 302 described below with respect to FIG. 4) of system 100 and is interpreted to initiate one or more functions. During use, button 240 may provide for an on-off toggle such that a user may depress button 240 to activate (turn-on) lights 230*a* and 230*b* and may subsequently depress button 240 to deactivate (turn-off) lights 230*a* and 230*b*. In some embodiments, system 100 may be configured such that various sequences of depressing button 240 provides for different functionality. For example, in some embodiments, system 100 and button 240 may be configured such that when lights 230*a* and 230*b* are already deactivated (e.g., system 100 is off) depressing button 240 may activate lights 230*a* and/or 230*b*. In some embodiments, both of lights 230*a* and 230*b* are activated upon the initial depression of button 240. In some embodiments lights 230*a* and 230*b* may be activated to the same states when system 100 was last active (e.g., prior to be turned off). For example, if light 230*a* was on and light 230*b* was off prior to turning off system 100, depressing button 240 will cause only light 230*a* to come on. If button 240 is again depressed within a give threshold of time (e.g., within one-half second) following depressing button 240, system 100 may cycle through various modes of operation. For example, where both lights 230*a* and 230*b* are activated upon initially depressing button 240, depressing button 240 a second time (e.g., within one-half second of the initial/first depression of button 240) may cause light 230*b* to turn off, depressing button 240 a third time (e.g., within one-half second of the second depression of button 240) may cause light 230*a* to turn off and light 230*b* to turn back on, and depressing button 240 a fourth time (e.g., within one-half second of the third depression of button 240) may cause light 230*a* to turn back on such that both lights 230*a* and 230*b* are again activated. Such a cycle may be repeated until the user does not depress button 240 within the given threshold of time. In some embodiments, after the threshold period of time has expired, depressing button 240 may turn system 100 off such that both lights 230*a* and 232*b* are deactivated. A user may turn-on or reactivate the system by again depressing button 240 as discussed above. Thus, a single button may provide for user input to define a plurality of functions including, for example powering on one or more of the lights, cycling through different functions and powering off the lights. Such a design may increase simplicity by reducing the number of user inputs. The reduced number of user inputs may be of particular benefit in the bathing environment as it reduces the likelihood of water entering the system by reducing the number of potential paths for water to enter system 100. In some embodiments, a plurality of buttons may be provided to operate one or a plurality of lights or other functions of system 100.

In certain embodiments, lighting system 100 operates on a timer such that they are activated for a given period of time, automatically turning off after the period of time has expired. The duration of the time period may be predetermined, and may be fixed or user selectable. For example, lights 230*a* and 23*b* may automatically turn off after twenty minutes after being turned on and/or after ten minutes without user interaction. In some embodiments, lighting system 100 may provide a warning or other indication that the time period is about to expire. In some embodiments, the lights may dim or flash prior a shirt period prior to the time period expiring the lights turning off. For example, lights 230*a* and/or 230*b* may dim for the last minute of the time period, thereby providing the user an opportunity to safely reactivate the light if desired. Thus, the user may have sufficient light to safely maneuver and in not abruptly subjected to an unlit environment in which they have to locate and reactivate the light.

In some embodiments, system 100 includes a portable power source, such as a battery. Use of a battery or similar portable power source may be particularly beneficial as the use of electrical cords may not be conducive for operation in a bathing environment. In some embodiments, a battery may include a rechargeable battery. Thus, a user may operate system 100, thereby depleting some of the battery's stored energy, and simply recharge the battery to enable future use of system 100. In some embodiments, charging of the battery may be provided via a plug or similar port provided in an exterior of housing. For example, in the illustrated embodiment, upper housing portion 200*a* includes a port/plug 244 disposed therein. Port/plug 244 may include an electrical connection that is coupled to the battery disposed internal to housing 200. For charging of the battery, a user may simply plug a complementary connector of a charging cable into port 244 to provide necessary power to charge the battery. In some embodiments, system 100 may operate using the power supplied by the battery and/or the power provided via the port 244. For example, in the instance where the battery is discharged, power for lights 230*a* and 230*b* may be provided via the plug/port 244 regardless of whether or not the battery has sufficient power to operate lights 230*a* and 230*b*. In some embodiments, a plug cover 246 may be provided. Plug cover 246 may be disposed within port/plug 244 during use to prevent water from entering system 100 via plug/port 244.

Figure 4:
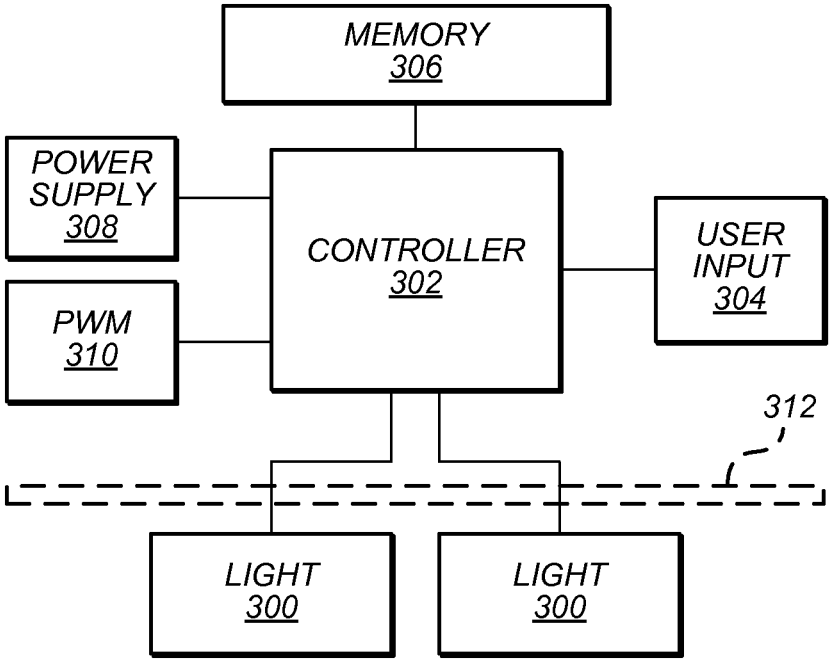
FIG. 4 is a schematic diagram that illustrates components of the lighting systems in accordance with one or more embodiments of the present technique.

FIG. 4 is a schematic diagram that illustrates components of lighting system 100 in accordance with one or more embodiments of the present technique. In some embodiments, system 100 may include two or more lights 300, a controller 302, a user input 304, a memory 306, and a power supply 308. Lights 300 may include illuminating components, such as lights 230*a* and 230*b* and lenses 232*a* and 232*b*. In some embodiments, controller 302 may regulate operation of light assemblies 300. For example, controller 302 may cycle activation of lights 230*a* and 230*b* dependent on an input received via user input 304. Controller 302 may also include a timing device that is capable of determining whether or not the input has been activated within a threshold period of time, as described above. In some embodiments, user input 304 may include button 240 or the like. Memory 306 may include a non-transitory computer readable storage medium. For example, memory may include an Electrically Erasable Programmable Read-Only Memory (EEPROM), flash memory or the like. Memory 306 may store logic or similar programming instructions that are executed by controller 302 during use. For example, memory 306 may store logic relating to the activation of lights 300 (e.g., lights 230*a* and 230*b*) and/or the cycling routine of lights 300 based on received user inputs, as described above. Power supply 308 may include a battery or other portable power source.

In some embodiments, lighting system 100 may include a pulse-width modulator (PWM) 310, as depicted in FIG. 4. PWM 310 may be employed to regulate the operation of lights 300. In some embodiments, PWM may be used to operate lights 300 in a pulse (e.g., rapid on-off cycling) condition as opposed to a substantially constant state. That is, PWM may be used to regulate pulsing or flashing lights 300 as opposed to having them operate in a manner in which they draw constant power. Pulsing lights 300 may increase battery life by a factor of two or more by decreasing the draw of power. In some embodiments, PWM 310 may be employed to pulse lights 300 at a high enough frequency that the pulse/flash/strobe is not readily apparent to the user. For example, lights 300 may be pulsed so rapidly that a human is not able to readily detect the pulsation of the lights. Thus, the user may not be aware of the pulsing/flashing/strobing and may be under the impression that the light is constantly illuminated, similar to that of traditional lighting.

In some embodiments, PWM 310 may provide one or more pulse train signals that drive pulsing/flashing/strobing of the one more ore lights at a frequency substantially corresponding to the frequency of the pulse train. In some embodiments, controller 302 may receive the pulse train having a frequency and regulate the power delivered to the lights such that the lights are pulsed/flashed/strobed at about a corresponding rate. In some embodiments, the pulse train may be provided directly to the lights to power them and provide for the pulsing/flashing/strobing of lights 300. In some embodiments, lights 300 may be illuminated during a high state or low state of the pulse train such that the pulsing/flashing/strobing of the light is controlled by the duration of the high and low states. During operation, the lights may be pulsed/flashed/strobed at the same or substantially the same frequency as the frequency of the pulse train. For example, a pulse train having a frequency of 1000 Hz may provide for pulsing/flashing/strobing of lights 300 at or near 1000 Hz. In some embodiments, the pulse train may have a frequency of greater than about 1000 Hz such that one or more of lights 300 are pulsed/flashed/strobed at greater than about 1000 Hz. In some embodiments, the pulse train may have a frequency of between about 1000 Hz and 2000 Hz such that one or more of lights 300 are pulsed/flashed/strobed at at corresponding frequency between about 1000 Hz to and 2000 Hz. In some embodiments, the pulse train may have a frequency of between about 5000 Hz and 7000 Hz such that one or more of lights 300 are pulsed/flashed/strobed at corresponding frequency between about 5000 Hz to and about 7000 Hz. For example, the pulse train may have a frequency of about 6250 Hz such that one or more of lights 300 are pulsed/flashed/strobed at about 6250 Hz.

In some embodiments, a single pulse train may be provided to all of the lights or multiple pulse trains may be provided to one or more lights to drive the lights at a rate corresponding to the frequency of the respective pulse train. In some embodiments, multiple lights are driven by a single pulse train. For example, where system 100 includes two lights 300, a pulse train signal (or at least two pulse train signals of substantially the same frequency and phase/timing) may be provided to both of the lights such that the first and second lights are both pulsed/flashed/strobed at a rate corresponding to the frequency of the pulse train. In some embodiments, multiple lights are driven by different pulse trains. For example, where system 100 includes two lights 300, a first pulse train signal may be provided to a first of the lights and a second pulse train signal may be provided to the second of the lights such that the first light is pulsed/flashed/strobed in coordination with the frequency and phase of the first pulse train and the second light is pulsed/flashed/strobed in coordination with the frequency and phase of the second pulse train.

In some embodiments, a pulse train signal provided to one or more lights may have a phase that is the same as another pulse train provide to one or more others of the lights. For example, where system 100 includes two lights 300, a first pulse train signal provided to a first of the lights and a second pulse train signal provided to the second of the lights may have aligned phases such that the first light is pulsed/flashed/strobed at substantially the same time as the second light is pulsed/flashed/strobed. In some embodiments, a pulse train signal provided to one or more lights may have a phase that is different from another pulse train provide to one or more others of the lights. For example, where system 100 includes two lights 300, a first pulse train signal provided to a first of the lights and a second pulse train signal provided to the second of the lights may have offset phases (i.e., first and second phases offset/delayed relative to one another) such that the first light is pulsed/flashed/strobed at a different time than the second light is pulsed/flashed/strobed. That is the lights may pulse/flash/strobe out of sync. Such an embodiment may provide for staggering the time in which the first and second lights are on and/or off. Staggering may help to increase the intensity of the lights as offsetting the power draw to each of the lights may enable a higher voltage to be provided to the lights as opposed to a lower voltage that may have to be split between each of the lights if they were pulsed/flashed/strobed at the same time. In some embodiments, the pulse trains are completely offset such that the pulse trains have opposite high and low states of approximately the same duration resulting in the first and second lights being alternatively pulsed/flashed/strobed one after the other. That is, one is on while the other is off and vice versa. In some embodiments, the phases are partially offset such that the pulse trains have high and/or low states that overlap such that the first and second lights are on and/or off at the same time during at least a portion of the operation.

In some embodiments, a pulse train signal provided to one or more lights may have a frequency that is the same as another pulse train provide to one or more others of the lights. For example, where system 100 includes two lights 300, first and second pulse train signals of the same frequency may be provided to both of the lights such that both of the lights are pulsed/flashed/strobed at the same rate corresponding to the frequency. In some embodiments, a pulse train signal provided to one or more lights may have a frequency that is different from another pulse train provided to one or more others of the lights. For example, where system 100 includes two lights 300, a first pulse train signal of a first frequency may be provided to a first of the lights and a second pulse train signal of a second frequency may be provided to the second of the lights such that the first light is pulsed/flashed/strobed at a rate corresponding to the first frequency and the second light is pulsed/flashed/strobed at a rate corresponding to the second frequency. In some embodiments, the phase and/or the frequency may be varied between pulse trains such that the timing and frequency of pulses/flashes/strobes of different lights are offset/delayed and/or provided at different rates.

In some embodiments, lighting system 100 includes a heat sink to distribute and regulate the movement of heat within an interior of housing 100. For example, in the illustrated embodiment, system 100 includes a heat sink 312 disposed between lights 300 and other components of system 100, including controller 302, power supply 308 and PWM 310. Such an embodiment may help to reduce the migration of heat generated by lights 300 and other components of system 100, including controller 302, power supply 308 and PWM 310. For example, during use, lights 300 may generate a substantial amount of heat that can result in internal temperatures of housing 200 that exceeds operating limits of other components (e.g., controller 302) or vice versa. Heat sink 312 may act as a partition to segregate various portions of an interior of housing 200 to inhibit heat from a device (e.g., light 300) in one portion of the interior of housing 200 from impacting operation of another device (e.g., controller 302) in another portion of housing 200 that is at least partially separated from the other portion by heat sink 312. Moreover, heat sink 312 may dissipate heat from adjacent components, such as lights 300, controller 302, power supply 308 and/or PWM 310. In some embodiment, heat sink 312 includes a conductive material (e.g., metal) to facilitate the distribution of heat from a component. In some embodiments, heat sink 312 may include a thin sheet or film that is can be easily disposed between components.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed or omitted, and certain features of the invention may be utilized independently, all as would be apparent to one skilled in the art after having the benefit of this description of the invention. Changes may be made in the elements described herein without departing from the spirit and scope of the invention as described in the following claims. Furthermore, note that the word "may" is used throughout this application in a permissive sense (i.e., having the potential to, being able to), not a mandatory sense (i.e., must). The term "include", and derivations thereof, mean "including, but not limited to". As used throughout this application, the singular forms "a", "an" and "the" include plural referents unless the content clearly indicates otherwise. Thus, for example, reference to "a light" may include a combination of two or more lights. The term "coupled" means "directly or indirectly connected".

What is claimed is:

1. A portable lighting system, comprising:

a housing comprising:

an elongated slot formed in a surface of the housing, wherein the slot is sized to receive a rod therein via an opening into the slot; and a retention member movable between a closed position and an opened position, wherein the closed position comprises at least a portion of the retention member blocking at least a portion of the upper opening of the slot, and wherein the opened position comprises the retention member not blocking the upper opening of the slot; and a light source comprising a plurality of lights oriented in different directions.

2. The portable lighting system of claim 1, wherein the light source comprises:

a first light oriented to provide illumination in a first direction of a first light axis; and a second light oriented to provide illumination in a second direction of a second light axis, wherein the first and second light axes are oriented oblique to one another.

3. The portable lighting system of claim 2, wherein each of the first and second lights are operable independent of one another.

4. The portable lighting system of claim 1, wherein the lights are configured to be operated at two or more different intensities of light.

5. The portable lighting system of claim 1, wherein the closed position comprises at least a portion of the retention member blocking at least a portion of the upper opening of the slot such that when the rod is disposed within the slot, the portion of the retention member inhibits removal of the rod from the slot, and wherein the opened position comprises the retention member not blocking the upper opening of the slot to facilitate insertion or removal of the rod into or out of the slot.

6. The portable lighting system of claim 1, wherein the housing comprises a substantially ellipsoid shape.

7. The portable bathing lighting system of claim 1, wherein the housing has a length of less than about six inches.

8. The portable lighting system of claim 1, wherein the retention member is biased to the closed position.

9. The portable lighting system of claim 1, wherein the housing is sealed such that the portable lighting system is substantially water proof.

10. The portable lighting system of claim 1, further comprising a grip member disposed on a surface of the slot, wherein the grip member is configured to inhibit movement of the housing relative to the rod.

11. The portable lighting system of claim 1, wherein the slot comprises a substantially semi-circular lower portion.

12. The portable lighting system of claim 11, wherein the slot comprises substantially flat sidewalls extending substantially tangential to the substantially semi-circular lower portion to define the opening of the slot.

13. The portable lighting system of claim 1, further comprising a portable power source.

14. The portable lighting system of claim 13, wherein the portable power source comprises a rechargeable battery.

15. The portable lighting system of claim 1, further comprising a single user input.

16. The portable lighting system of claim 1, wherein the light source operates on a timer such that the lights automatically turn off after expiration of a time period.

17. The portable lighting system of claim 16, wherein the lights operate at a reduced intensity for a short period preceding the expiration of the period of time such that a user is alerted that the lights are scheduled to automatically turn off soon.

18. The portable lighting system of claim 1, wherein the light source comprises a pulse width modulator configured to regulate the power to the lights such that the lights are pulsed.

19. The portable lighting system of claim 1, further comprising a controller and a heat sink disposed between the controller and the light source.

20. A portable lighting system, comprising:

a housing configured to couple to a rod in a bathing environment; and a light source configured to broadcast light to multiple portions of the bathing environment during use.

* * * * *